US011168852B1

(12) United States Patent
Irons et al.

(10) Patent No.: US 11,168,852 B1
(45) Date of Patent: Nov. 9, 2021

(54) CHANNELS AND LENSES FOR LINEAR LIGHTING

(71) Applicant: Elemental LED, Inc., Reno, NV (US)

(72) Inventors: Travis Irons, Reno, NV (US); Robert Green, Reno, NV (US); David Greenspan, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/201,591

(22) Filed: Mar. 15, 2021

Related U.S. Application Data

(63) Continuation of application No. 17/130,935, filed on Dec. 22, 2020.

(60) Provisional application No. 63/037,885, filed on Jun. 11, 2020.

(51) Int. Cl.

| | |
|---|---|
| ***F21S 4/00*** | (2016.01) |
| ***F21S 4/28*** | (2016.01) |
| ***F21V 5/04*** | (2006.01) |
| ***F21V 3/10*** | (2018.01) |
| ***F21V 23/00*** | (2015.01) |
| *F21Y 103/10* | (2016.01) |

(52) U.S. Cl.
CPC *F21S 4/28* (2016.01); *F21V 3/10* (2018.02); *F21V 5/045* (2013.01); *F21V 23/002* (2013.01); *F21Y 2103/10* (2016.08)

(58) Field of Classification Search
CPC .... F21S 4/20; F21S 4/28; F21V 23/00; F21V 23/002; F21V 21/08; F21V 21/008; F21V 23/001; F21V 23/023; F21Y 2103/10; F21Y 2105/14
See application file for complete search history.

(56) References Cited

U.S. PATENT DOCUMENTS

| | | | |
|---|---|---|---|
| 9,279,544 | B1 | 3/2016 | Dankelmann et al. |
| 9,565,769 | B2 | 2/2017 | Dankelmann et al. |
| 10,557,600 | B1 | 2/2020 | South |
| 10,724,720 | B1 | 7/2020 | Heredia |
| 10,788,170 | B1 | 9/2020 | Bryan |
| 2003/0223235 | A1 | 12/2003 | Mohacsi et al. |
| 2011/0305024 | A1 | 12/2011 | Chang |
| 2012/0014108 | A1 | 1/2012 | Greenfield et al. |
| 2016/0061387 | A1 | 3/2016 | Liang et al. |
| 2016/0169503 | A1 | 6/2016 | Chen et al. |
| 2021/0116120 | A1* | 4/2021 | Tan et al. ..... F21V 21/088 |
| 2021/0215323 | A1 | 7/2021 | Flynn et al. |

* cited by examiner

*Primary Examiner* — Y M. Quach Lee

(74) *Attorney, Agent, or Firm* — United IP Counselors, LLC

(57) ABSTRACT

Channels and channel covers for linear lighting are disclosed. The channels have an upper compartment for linear lighting and a lower compartment that may be used as a raceway, to engage parts, and for rear entry of wires. Endcaps for the channels may engage the lower compartment. Cover-lenses for linear lighting channels are also disclosed. The cover-lenses may include diffusing material and implement a thickness gradient in order to maximize the amount of diffusing material where the emitted light intensity is expected to be greatest. Diverging Fresnel features may be superimposed on the thickness gradient in order to counteract any converging effect of the thickness gradient and cause emitted light to spread more evenly.

13 Claims, 10 Drawing Sheets

CHANNELS AND LENSES FOR LINEAR LIGHTING

CROSS-REFERENCE TO RELATED APPLICATIONS

This application is a continuation of U.S. application Ser. No. 17/130,935, filed Dec. 22, 2020, which claims priority to, and the benefit of, U.S. Provisional Patent Application No. 63/037,885, filed Jun. 11, 2020. The contents of those applications are incorporated by reference herein in their entirety.

TECHNICAL FIELD

The invention relates to lighting in general, and in particular, to linear luminaires.

BACKGROUND

Linear lighting is a particular type of solid-state lighting that uses light-emitting diodes (LED). In this type of lighting, a long, narrow printed circuit board (PCB) is populated with LED light engines, usually spaced at a regular pitch or spacing. The PCB may be either rigid or flexible, and other circuit components may be included on the PCB, if necessary. Depending on the type of LED light engine or engines that are used, the linear lighting may emit a single color, or may be capable of emitting multiple colors.

In combination with an appropriate power supply or driver, linear lighting is considered to be a luminaire in its own right, and it is also used as a raw material for the production of more complex luminaires, such as light-guide panels. In practice, strips of PCB may be joined together in the manufacturing process to produce linear lighting of essentially any length. Spools of linear lighting 30 meters (98 ft) in length are common, and spools of linear lighting 100 meters (328 ft) in length are commercially available.

One of the most popular ways of using linear lighting is to install it in a channel and cover it with a cover. The channel offers protection, and the cover typically acts as a diffuser, spreading the light and improving the overall appearance of the emitted light. Examples of channels used with linear lighting can be found in U.S. Pat. No. 9,279,544, the contents of which are incorporated by reference in their entirety. The typical channel for linear lighting is a single-piece extrusion, made of metal or plastic, that has a pair of sidewalls and a bottom.

BRIEF SUMMARY

One aspect of the invention relates to a linear luminaire. The linear luminaire includes a channel and a strip of linear lighting. The channel has generally H-shaped cross-section, such that a cross-member divides the channel into upper and lower compartments. The upper compartment is adapted to house the strip of linear lighting. The sidewalls of the upper compartment have structure adapted to engage a cover to cover and close the upper compartment. The cross-member may not be positioned at the vertical center of the channel, which means that the lower compartment may be shallower than the upper compartment. The lower compartment may serve as a raceway for wiring and has its own engaging structure that may, for example, be adapted to engage mounting clips and other such elements. In order to provide the maximum amount of space possible for linear lighting, end caps and other such structures may have complementary engaging structure adapted to engage the engaging structure of the lower compartment.

Another aspect of the invention relates to a cover for diffusing light emitted by linear lighting. The cover comprises an optically-transmissive material with a diffusing additive. In one embodiment, the diffusing additive is distributed uniformly within the optically-transmissive material. In order to provide more diffusion where emitted light intensity is greatest, the cover is thickest where the light intensity is expected to be greatest, and implements a gradient such that it is thinnest where the emitted light intensity is expected to be weakest. In an embodiment where the linear lighting is expected to be centered in the channel, this results in a cover-lens with a plano-convex shape. However, in at least some embodiments, the plano-convex shape of the cover-lens would undesirably cause the emitted light rays to converge. Therefore, the cover-lens may also implement Fresnel-style grooves arranged to cause the emitted light to diverge and spread, counteracting at least some of the effect of the underlying plano-convex shape.

Yet another aspect of the invention relates to methods for assembling linear luminaires, and in particular, for connecting a strip of linear lighting to power. In these methods, a strip of linear lighting is placed on a surface of a channel. Wire leads are routed through openings in the surface of the channel. The openings in the surface of the channel are aligned with connection points, such as solder pads, on the strip of linear lighting. In many cases, the surface of the channel will be a surface of an interior compartment, such as the bottom surface, and the holes in the surface of the channel will open into an adjacent compartment.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
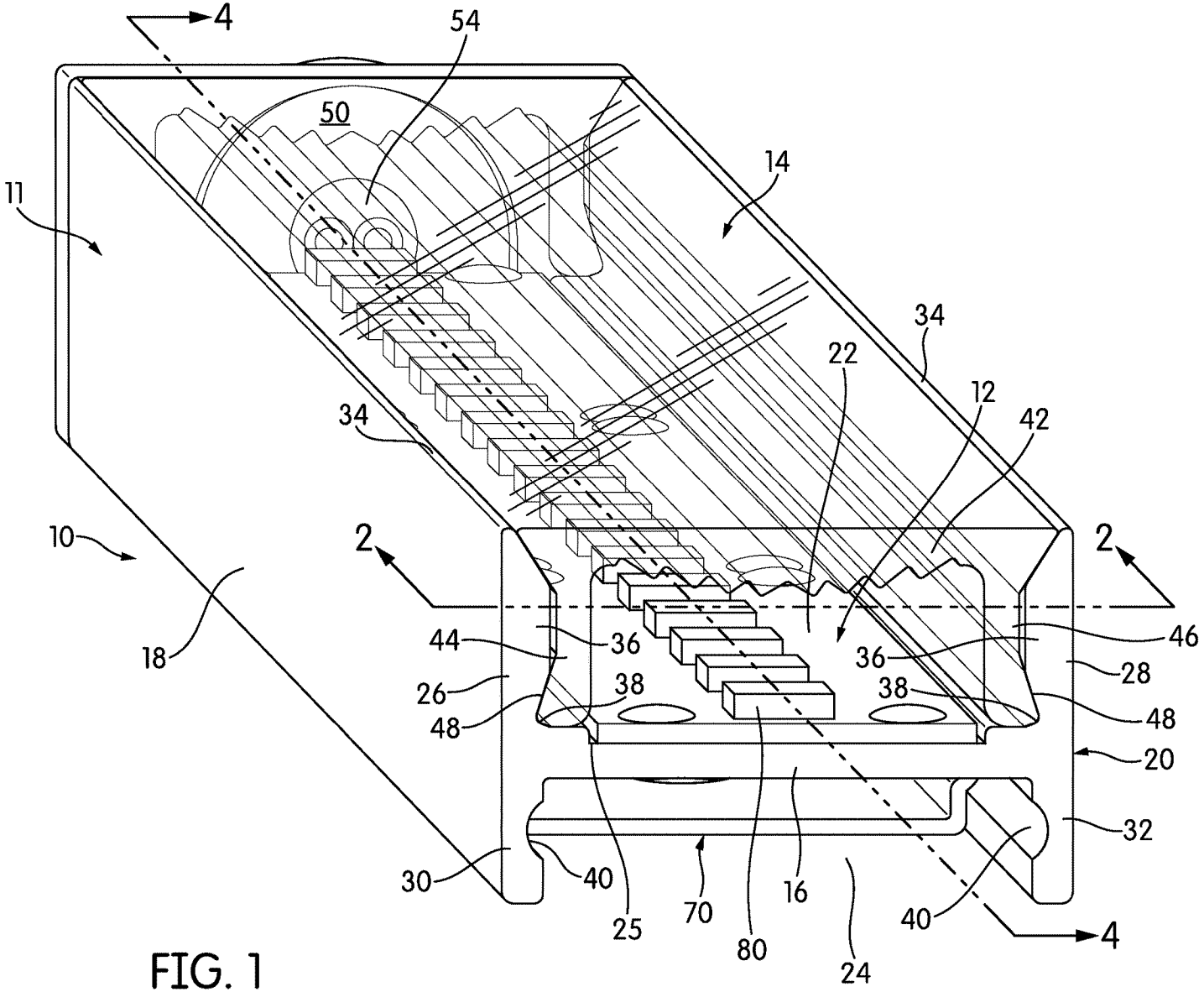
FIG. 1 is a perspective view of a linear luminaire according to one embodiment of the invention.

FIG. 1 is a perspective view of a luminaire, generally indicated at 10, shown with one end open for purposes of illustration. The luminaire 10 includes a channel 11, which is shown with a strip of linear lighting 12 installed, and is covered with a cover-lens 14, as will be described below in more detail.

The channel 11 has a generally H-shaped cross-section, with a cross-member 16 extending generally horizontally between two sidewalls 18, 20. The cross-member 16 and sidewalls 18, 20 define two compartments in the channel 11: an upper compartment 22, in which the linear lighting 12 is installed, and a lower compartment 24. With respect to the coordinate system of FIG. 1, the upper compartment 22 opens up, and the lower compartment opens down. As can be seen in FIG. 1, the cross-member 16 is not vertically centered along the sidewalls 18, 20; its position below the horizontal centerline of the channel 11 makes the upper compartment 22 deeper than the lower compartment 24. However, in other embodiments, the two compartments 22, 24 may have different relative heights.

The linear lighting 12 is installed on the bottom 25 of the upper compartment 22. Typically, this is done by using a layer of pressure-sensitive adhesive on the underside of the linear lighting 12 itself, although other types of adhesives, clips, and other means of securement may be used. Much of this description will assume that the linear lighting 12 is flexible, with a PCB made, e.g., of biaxially-oriented polyethylene terephthalate (MYLAR®) or polyimide, to name a few possible materials.

Each compartment 22, 24 has sidewall features that are particularly adapted for the function of the compartment 22, 24. In particular, the upper sidewalls 26, 28 are adapted to engage and secure the cover-lens 14. The lower sidewalls 30, 32 are adapted to receive and engage mounting clips. As will be described below in more detail, the lower compartment 24 may also be used as a raceway for wiring, and the lower sidewalls 30, 32 may be adapted for that function and other functions as well.

Figure 2:
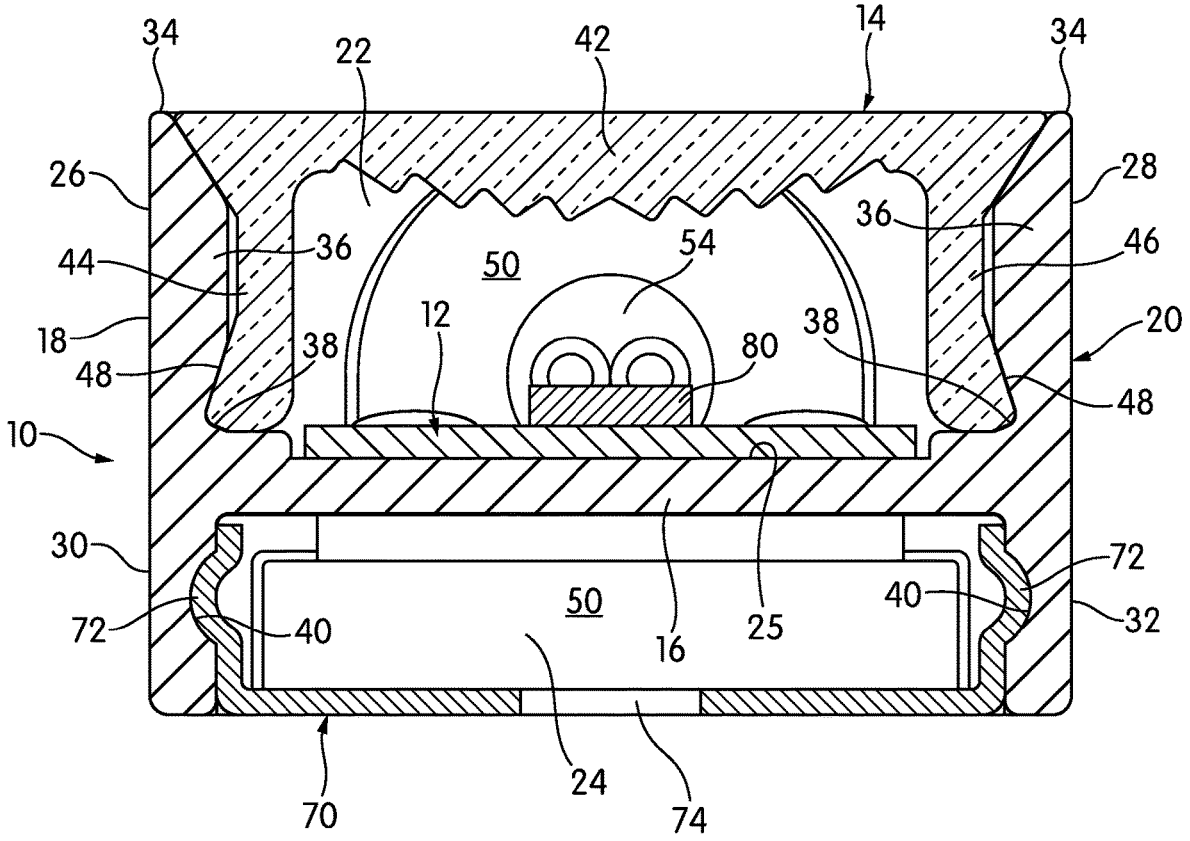
FIG. 2 is a cross-sectional view, taken through Line 2-2 of FIG. 1.

FIG. 2 is a cross-sectional view of the luminaire 10, illustrating the shape of the channel 11 and the shapes of the sidewalls 18, 20 in more detail. In general, the two sidewalls 18, 20 are mirror images of one another in the illustrated embodiment, although that need not be the case in all embodiments. As can be seen in FIG. 2, the upper sidewalls 26, 28 of the illustrated embodiment flare inward, forming features that are designed to be engaged by the cover-lens 14. More specifically, from a relatively thin top edge 34, each upper sidewall 26, 28 cants inward at an angle to a vertically-extending plateau that is parallel, or at least generally parallel, with the outer face of the upper sidewall 26, 28, and then cants outward at another angle, which may be the opposite of the first angle. This results in an inward projection 36 that resembles a trapezoid. The projection 36 and its various contours extend over much of the vertical height of the upper sidewalls 26, 28. Below the projection 32 on each upper sidewall 26, 28, a notch or groove 38 is formed.

Each lower sidewall 36, 38 has an inset rounded groove 40. As those of skill in the art will understand, the exact features of the upper sidewalls 26, 28 and lower sidewalls 30, 32 may vary from embodiment to embodiment, so long as they complement the features of the structures they are intended to engage. That said, the particular features 36, 38, 40 of the channel 11 do have certain advantages. Those advantages can be seen in FIG. 2 and also in the exploded perspective view of FIG. 3.

In particular, the cover-lens 14 has a top section 42 and a pair of depending legs 44, 46, one on each side. The legs 44, 46 are mirror images of one another, and the outward side 48 of each leg 44, 46 has contours that match the contours of the upper sidewalls 26, 28, particularly the projections 36 of the upper sidewalls 26, 28. When the cover-lens 14 is installed over the channel 11, the legs 44, 46 of the cover-lens 14 deflect inwardly slightly to seat the cover-lens 14.

The projections 36 and complementary shape of the outward side 48 of each leg 44, 46 of the cover-lens 14 are relatively large, using a substantial portion of the vertical height of the upper sidewalls 26, 28. The relatively large size of the complementary engaging features and the relative lack of small or intricate features may improve the manufacturability and fit of the components. The large sizes and areas of the complementary engaging components may also make it less likely that the components will spontaneously disengage. By comparison, the channels of U.S. Pat. No. 9,279,544 and their corresponding covers are relatively fine-featured with short depending legs, which means that manufacturing to the necessary tolerances can be more difficult. Additionally, it may be more difficult to achieve and maintain positive engagement with such small features.

Figure 3:
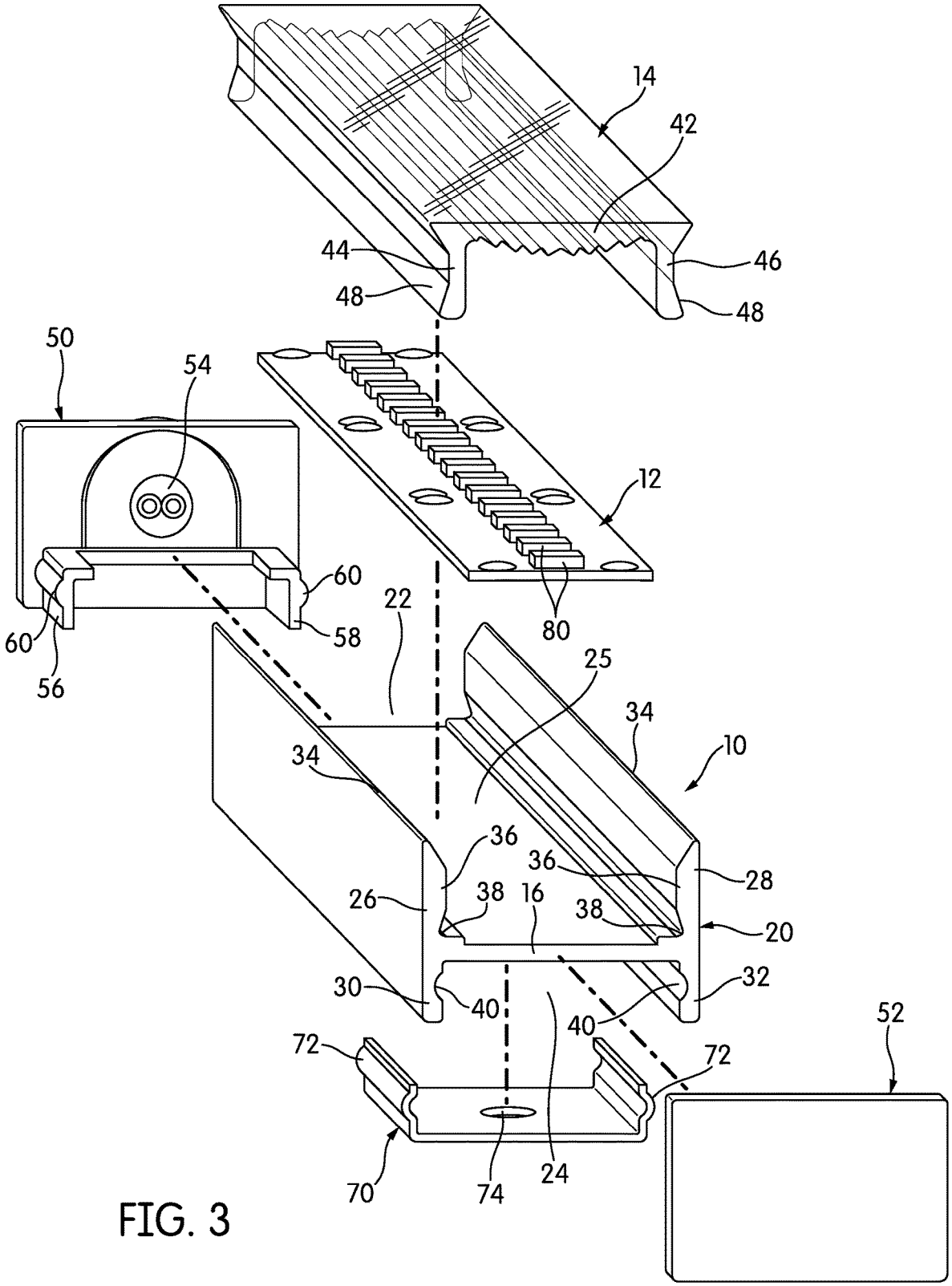
FIG. 3 is an exploded perspective view of the channel of FIG. 1.

FIGS. 1-3 show certain other components that may be fitted to the channel 11. As shown particularly in the exploded view of FIG. 3, each end of the channel 11 is closed with an endcap 50, 52. The two endcaps 50, 52 have the same structure for mating with the channel 11, but differ somewhat in that one endcap 50 carries and provides structure for passing a power cable 54, while the other does not. In some embodiments, a channel 11 may have two endcaps 50 that carry power cords while in other embodiments, a channel 11 may have two closed endcaps 52 that do not carry power cords. As will be described below in more detail, two endcaps 50 with power cords would allow multiple channels 10 to be "daisy chained" together with flexible lengths of cord 54 between them. Two endcaps 52 without structure for passing a power cable 54 would be used if power is to be routed into the channels 10 using another path, as will be described below in more detail.

Each endcap 50, 52 has structure that is intended to mount and secure it within the channel 11. Notably, in this embodiment, this structure does not rest within the upper compartment 22. Instead, a pair of projections 56, 58 are positioned on the endcaps 50, 52 to insert into the lower compartment 24, and have features 60 that complement and insert into the rounded grooves 40 in the lower sidewalls 30, 32. The features 60 in this case are roughly hemispherical strips that match the rounded grooves 40. In some cases, the endcaps 50, 52 may rely on a tight fit or an interference fit to stay in place; in other cases, adhesives may be used on the mating surfaces to provide additional securement.

In order to supply power, the strip of linear lighting 12 is connected to a power cable 54. The far end of the power cable 54 would be connected to a power supply, such as a driver, which is not shown in the figures. On the near side of the power cable 54, a strain relief 62, is present. (The strain relief 62 is best seen in the longitudinal cross-sectional view of FIG. 4.) The strain relief 62 of this embodiment has the general form of a grommet that is seated in the endcap 50. In some embodiments, the strain relief 62 may be co-molded with the power cable 54 or fused to it after manufacture; in other embodiments, the power cable 54 and strain relief 62 may move relatively freely with respect to one another. In yet other embodiments, the two components 50, 52 may be separate but rely on a tight or frictional fit.

As a general matter, the strip of linear lighting 12 may accept low voltage or high voltage power. While the definitions of low voltage and high voltage may differ depending on the authority one consults, for purposes of this description, "low voltage" will refer to voltages under about 50V. If the strip of linear lighting 12 accepts high voltage power, it may have additional structure, such as an encapsulating covering, to provide electrical insulation and isolation.

The power cable 54 that is shown in the figures has two power leads, a positive lead and a minus-return. These are typically connected to the strip of linear lighting 12 by soldering to defined solder pads on the strip of linear lighting 12, although connectors may be used in some situations. As was described above, some LED light engines have multiple types of LEDs, for example, red, green, and blue, or LEDs arranged to emit different color temperatures of white light. LED light engines such as these may require multiple leads. The type of LED light engine and the type of power cable 54 are not critical to the invention. Moreover, while the term "power cable" is used here for ease in description, multi-conductor cables may carry both power and data.

As the description above thus bears out, the lower compartment 24 has several functions. First, as can be seen in several of the figures, U-shaped mounting clips 70 have upwardly-extending sidewalls with projections 72 that are complementary in shape to the rounded grooves 40 of the lower sidewalls 30, 32 and are designed to engage the lower compartment 24 to secure the channel 11 to an exterior surface. As shown, each mounting clip 70 also carries an opening 74 to secure a fastener. The fastener secures the mounting clip 70 to the exterior surface.

Figure 4:
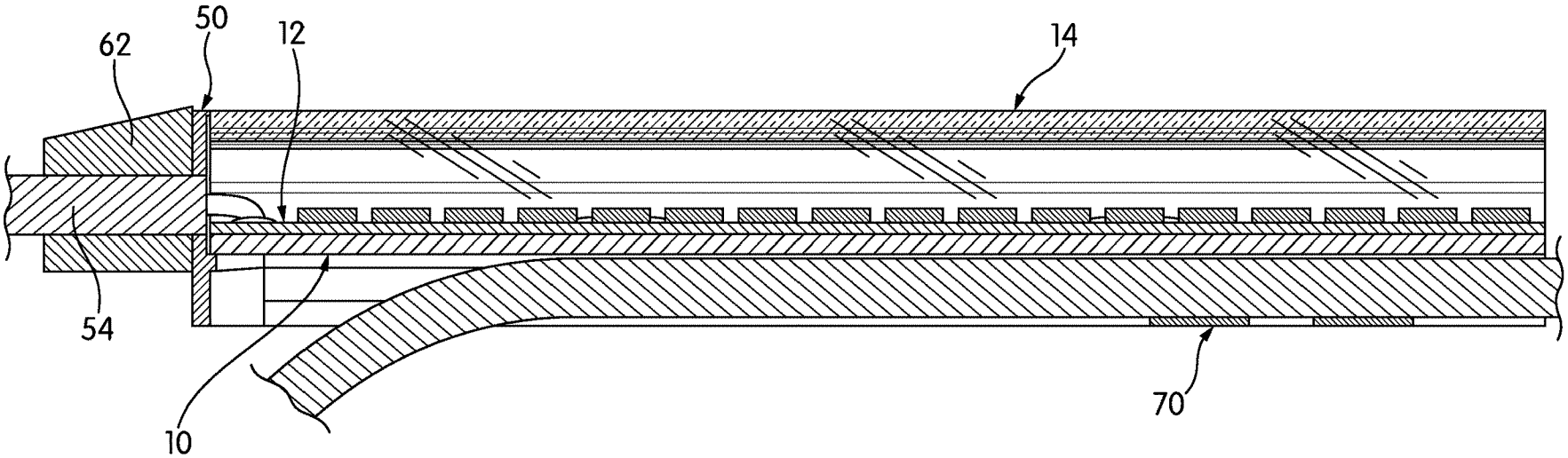
FIG. 4 is a cross-sectional view, taken through Line 4-4 of FIG. 1.

Additionally, as can be seen in FIG. 4, a longitudinal cross-section of the luminaire 10 taken through Line 4-4 of FIG. 1, the lower compartment 24 can be used as a raceway for wiring. There are many situations in which it may be helpful to pass cables through the lower compartment 24. For example, if several lengths of channel 11 are used in the same installation, while it is possible to "daisy chain" several lengths of channel 11 together (i.e., connect them end-to-end) so that they are powered in series, it is also common for each length of channel 11 to make a "home run" and connect with a driver directly, so that each length of channel 11 is powered in parallel. The cables for each length of channel 11 may pass through the lower compartment 24 as a raceway. The lower compartment 24 may also act as a raceway for cabling from other components, such as color controllers, switches, and the like.

Figure 5:
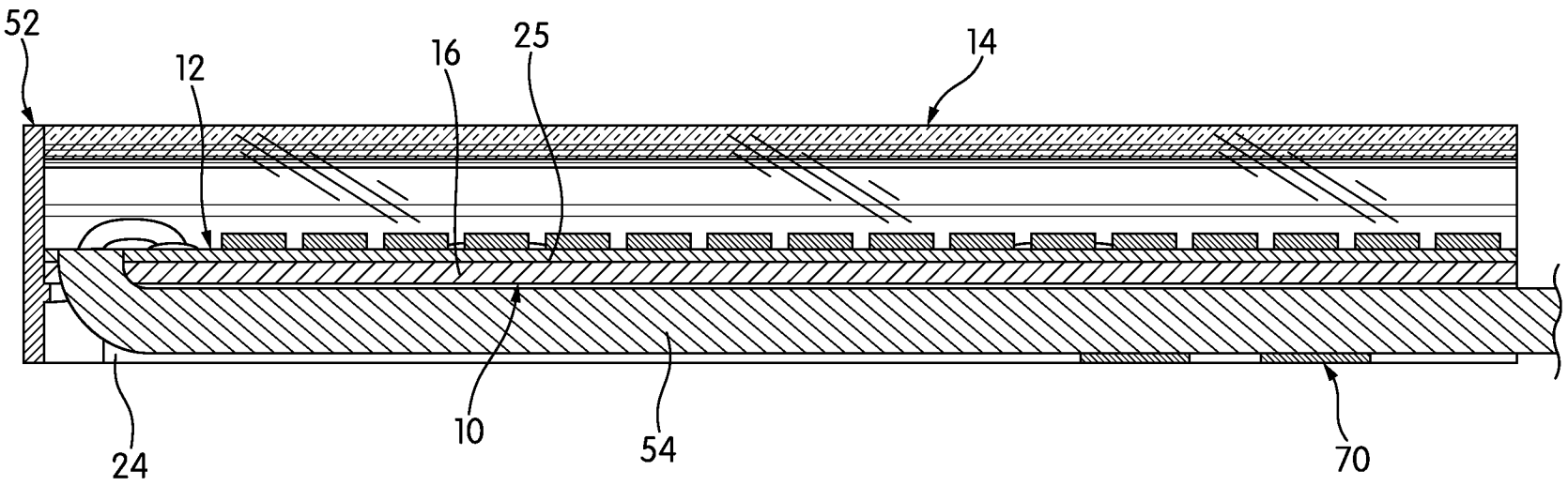
FIG. 5 is a cross-sectional view, similar to the view of FIG. 4.

In some cases, the power cable 54 may traverse the lower compartment 24 and enter through an opening in the cross-member 16 and the bottom 25 and the channel 11, as shown in FIG. 5, a longitudinal cross-sectional view similar to the view of FIG. 4. As shown in FIG. 5, if a power cable 54 enters from this direction, it may be necessary to space the linear lighting 12 a short distance away from the end of the channel 11, in order to provide room to connect the power leads to the linear lighting 12.

"Bottom entry" of the power cable 54 has certain advantages. For example, the channel 11 can be capped with two plain endcaps 52. In this arrangement, there is no need for an endcap 50 with a strain relief. There is also no need to provide space at the end of the channel 11 for the entering power cable 54.

Cover-Lens

Channels 10 according to embodiments of the invention may be used with a variety of covers and lenses, ranging from clear and diffused covers with no lensing effects or properties to covers that have both diffusive and lensing effects. Any cover that has legs 44, 46 or other such structure that will snap into the channel 11 can be used. Moreover, while the features of the cover-lens 14 are described here relative to the channel 11, the features described here may be adapted for other types of channels.

Figure 6:
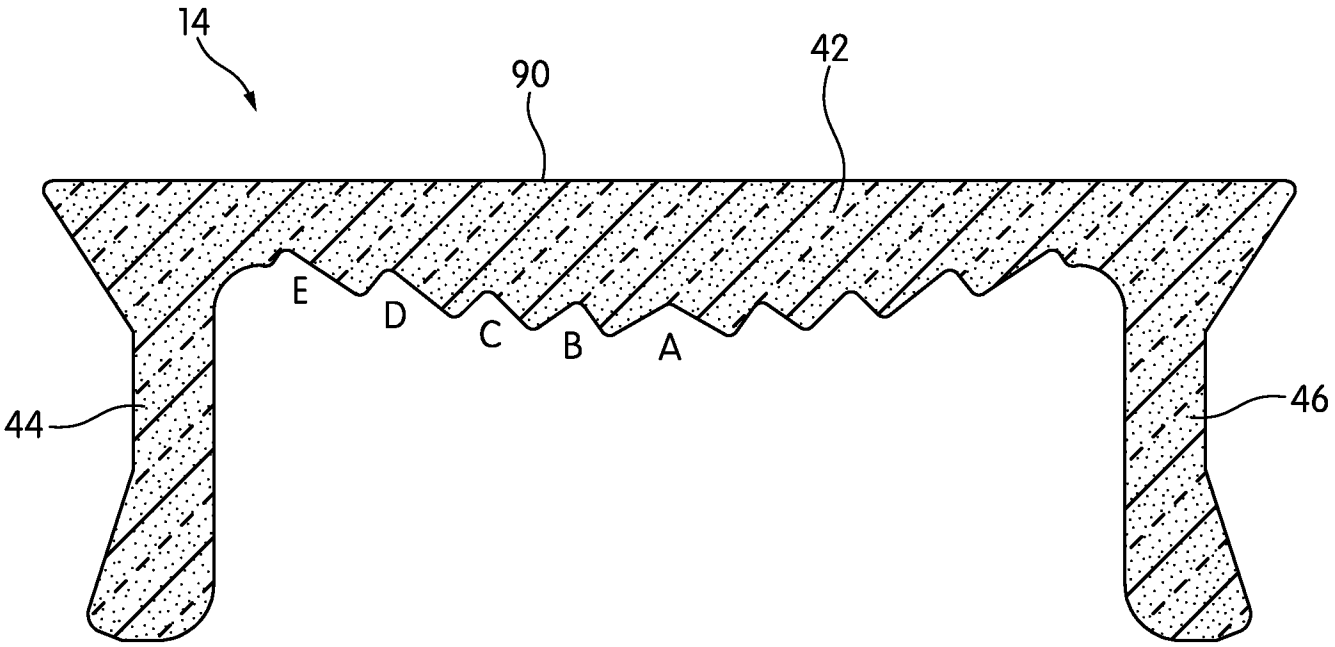
FIG. 6 is a cross-sectional view of the cover-lens of the channel of FIG. 1, shown in isolation.

FIG. 6 is a cross-sectional view of the cover-lens 14, shown in isolation. The cover-lens 14 has certain specific features that may be advantageous in at least some applications. More specifically, the cover-lens 14 has both diffusing and lensing properties and is adapted to produce as uniform light emission as possible along the width of the luminaire 10. "Diffusion" and "diffusing effects," as those terms are used here, refer to the spreading or scattering of transmitted or reflected beams of light, typically by transmission through (and refraction by) a non-uniform medium or refraction at a surface or interface between two dissimilar materials.

The cover-lens 14 may be made of any suitable optical material, including glass or plastic, although plastic may be preferred in many embodiments because of its low cost and durability. Typically, a plastic would be extruded into the shape of the cover-lens 14. The plastic may be acrylic, polycarbonate, or other such plastics. The cover-lens 14 of the illustrated embodiment also has embedded diffusing material. For example, silica, fumed silica, or titanium dioxide microspheres in a base material of acrylic or polycarbonate may be particularly suitable in some embodiments. For purposes of this description, the material of the cover-lens 14 may be assumed to be polycarbonate with titanium dioxide microspheres as diffusing material.

Assuming that the linear lighting 12 is installed with the LED light engines centered in the channel 11 as shown in FIG. 1, the intensity of the emitted light is greatest near the center of the channel 11 and the center of the cover-lens 14. In order to achieve a uniform emitted light appearance, more diffusing material is needed at and around the center of the cover-lens 14, while less diffusing material is needed closer to the edges of the cover-lens 14. In the illustrated embodiment, the diffusing additive is distributed uniformly within the material of the cover-lens 14. Therefore, in order to provide more diffusing material on center and less toward the edges, the inner center of the cover-lens 14 is thickened relative to the sides, and the thickness of the cover-lens 14 gradually decreases toward the edges. Overall, this provides the cover-lens 14 with a plano-convex appearance, the planar surface 90 of the cover-lens 14 facing outward. However, the convexity of the cover-lens 14 (i.e., the thickness of the cover-lens 14 at any one point) is determined solely by the intensity of emitted light from center toward edges and the commensurate need to provide more or less diffusing material, and not by focal considerations. The difference in thickness between the center and the edges may be, e.g., on the order of about 1.25 mm.

The distribution of the emitted light, and thus, the thickness gradient of diffusing material necessary to produce a uniform intensity of light across the width of a cover-lens 14, will differ depending on the nature of the linear lighting 12 and its LED light engines. An LED light engine, as the term is used here, refers to one or more LEDs in a package. The package allows the light engine to be mounted on a PCB by a common technique, such as surface mounting. LED light engines are generally indicated at 80 in the views of FIGS. 1-3.

Depending on the nature of the light that is to be emitted, the package may be topped with a phosphor that absorbs the light emitted by the LEDs and re-emits that light in a desirable color or spectrum. In a typical commercial LED light engine intended to emit "white" light, the LEDs in question are blue-emitting LEDs, and the phosphor absorbs blue light and emits a broader spectrum of light that appears to the observer to be white light. The re-emitted light is not usually of a single color; in fact, the typical spectral power distribution of the light spans the visible light spectrum.

Most LED light engines have a natural beam width in the range of about 120°-130°, full-width, half-maximum. That beam width may vary depending on the characteristics of the package, the characteristics of the LEDs in the package, and the characteristics of the phosphor on top of the package, if any. In particular, phosphor typically varies in thickness across its diameter or width.

The resulting convexity of the cover-lens 14 would normally have the effect of converging the emitted light at some focal point in front of the cover-lens 14. However, in this embodiment, that is undesirable; rather than causing the light to converge, the goal is to spread the light evenly. Therefore, the cover-lens 14 uses Fresnel technology superimposed on the basic plano-convex curve in order to cause emitted light to diverge or, at least, to avoid convergence.

As those of skill in the art will understand, a Fresnel lens takes advantage of the fact that in a lens, light refracts only at interfaces between different materials. This means that, for purposes of basic refraction, the thickness of the lens is essentially immaterial. A Fresnel lens is thus typically thinner than a conventional lens, as it reduces the lens surface to a series of discontinuous grooves, each groove having approximately the same outer curvature as an equivalent point on a comparable lens.

In the illustrated embodiment, the cover-lens 14 is symmetrical about its centerline. In the center area, indicated by "A" in FIG. 6, the two facets make a 120° angle with respect to each other and a 30° angle with respect to the planar surface 90. Each side of the cover-lens 14 has four facets, indicated as B-E in FIG. 6. Facet B makes an angle of 35.21° with respect to the planar surface 90, facet C an angle of 44.9°, facet D an angle of 51.39°, and facet E an angle of 56.15°. Essentially, the facets become steeper from the centerline toward the edges of the cover-lens 14. The particular facet-angles may vary somewhat from embodiment to embodiment, so long as the angles are such that the configuration will not create shadows. The particular number of facets may also vary from embodiment to embodiment, and any number of facets may be used so long as the features of those facets can be physically reproduced during the manufacturing process. As can also be appreciated from the view of FIG. 6, the roots of the facets have rounded corners instead of sharp corners, again for ease in manufacturing.

Additional Embodiments

Figure 7:
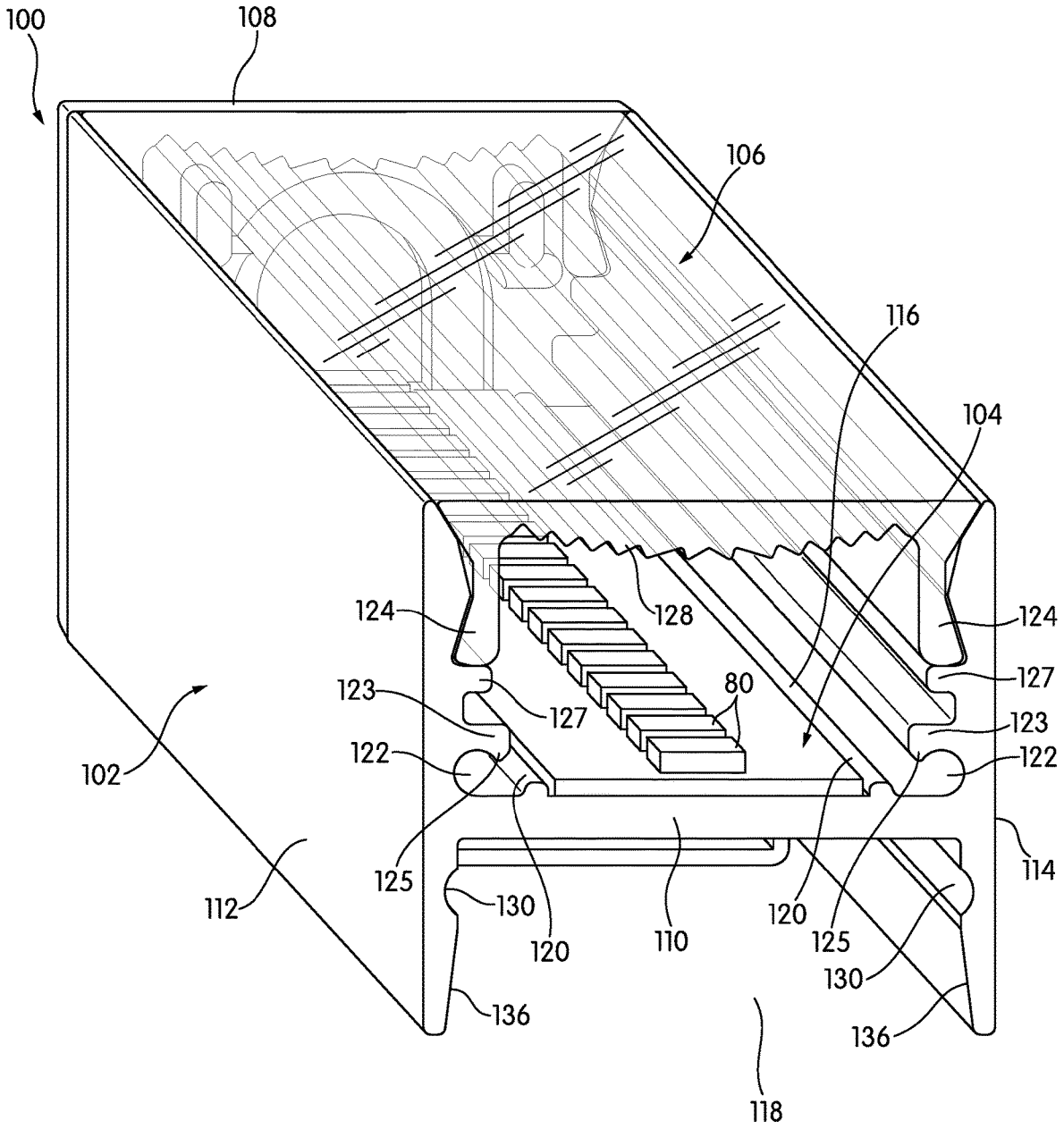
FIG. 7 is a perspective view of a linear luminaire according to another embodiment of the invention.

FIG. 7 is a perspective view of a luminaire, generally indicated at 100, according to another embodiment of the invention. The luminaire 100 is similar in many respects to the luminaire 10 described above, and includes a channel 102, linear lighting 104 disposed in the channel 102, and a cover 106 covering the channel 102. As with FIG. 1, for ease in explanation and visualization, one end of the luminaire 100 is open in FIG. 7, although both ends would typically be covered by endcaps 108. In the view of FIG. 1, one endcap 108 has been removed so that internal components are visible.

As with the channel 11, the channel 102 has an H-shaped cross-section, with a cross-member 110 extending horizontally between two vertical sidewalls 112, 114 to divide the channel 102 into an upper compartment 116 and a lower compartment 118. In this embodiment, the upper compartment 116 is taller than the upper compartment 22 of the channel 11. However, the two compartments 116, 118 of this embodiment do not have equal sizes; that is, the cross-member 110 is not positioned at the horizontal centerline of the sidewalls 112, 114.

Each compartment 116, 118 has additional features. As can be seen in FIG. 7 and in the end cross-sectional view of FIG. 8, alignment features 120 extend on both sides of the linear lighting 104. In this embodiment, the alignment features 120 are raised ridges that arise from the floor of the upper compartment 116, i.e., from the upper side of the cross-member 110. The alignment features 120 may make it easier for an installer to lay linear lighting 104 straight across the channel 102. Additionally, the channel 102 has a circular groove 122 on each side at the junction between the cross-member 110 and the sidewall 112, 114. The circular groove 122 is of sufficient dimension to allow a power or power/data cable to be pressed into it, so that the grooves 122 can be used as raceways for cables if desired. The inwardly-extending flanges 123 that define the upper extents of the circular grooves 122 have downwardly-extending points 125 to aid in cable retention.

The cover 106 for the channel 102 has similar structure to that described above, and is retained in the channel 102 by two depending legs 124, each with relatively large features. Upper portions 126 of the sidewalls 112, 114 have complementary features to engage the legs 124. In this embodiment, the legs 124 of the cover 106 do not extend down to the floor of the upper compartment 116. Instead, a pair of inwardly-extending flanges or ledges 127 positioned on each side of the channel 102 extending inwardly from respective sidewalls 112, 114 at a position a little less than halfway up the sidewalls 112, 114 of the upper compartment 116.

Figure 8:
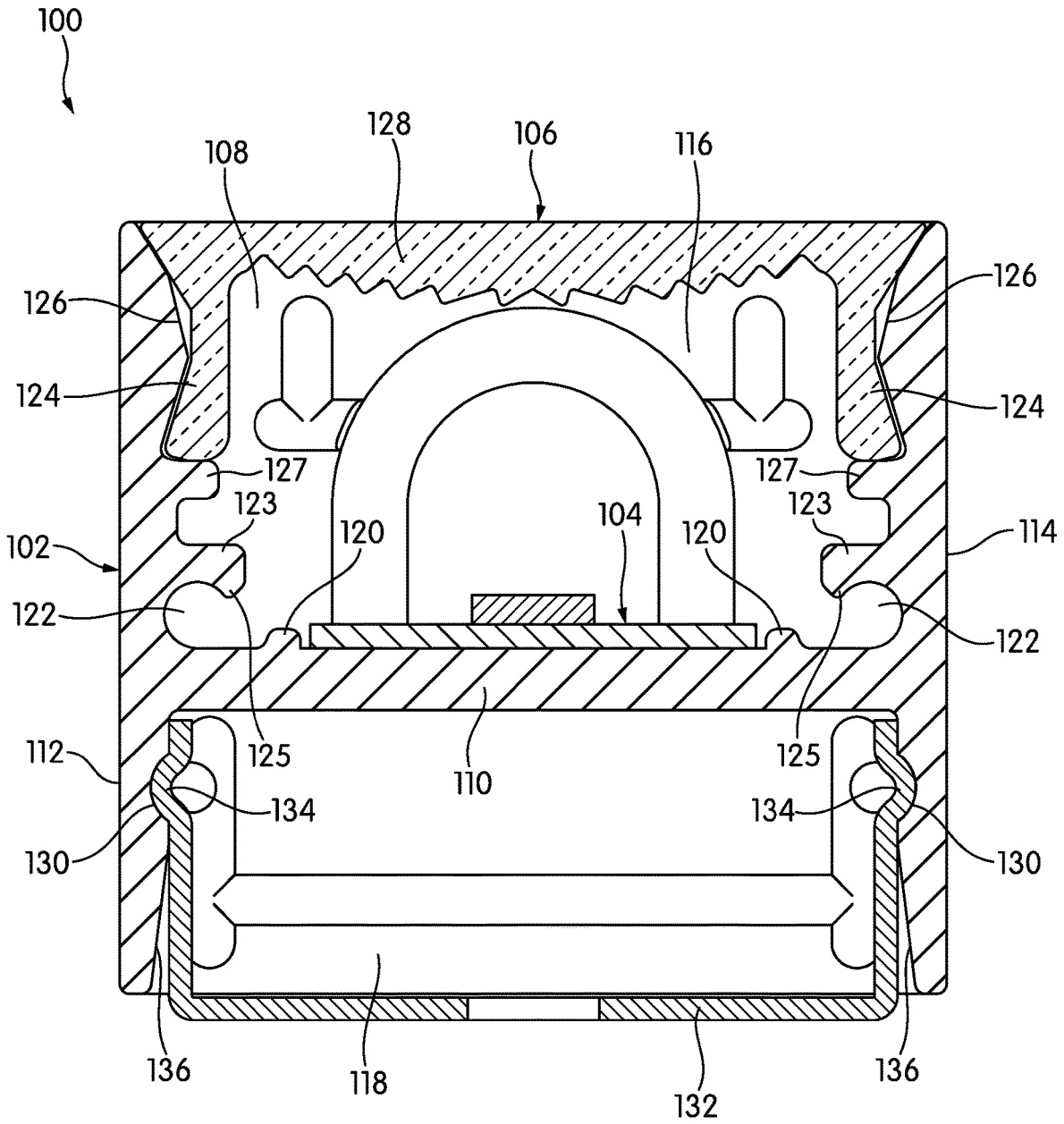
FIG. 8 is an end cross-sectional view of the linear luminaire of FIG. 7.

The cover 106 has the features described above with respect to the cover-lens 14, including diffusing material and a thickness gradient that places the thickest part of the gradient (and thus, the most diffusing material) on center, where the LED light engines 80 are. Relative to the cover-lens 14 described above, the cover 106 may have a gradient with different thicknesses to compensate for the greater distance between the linear lighting 104 and the cover 106. Additionally, as can be seen in FIG. 8, the Fresnel lens portion 128 of the cover 106 has more facets than the cover-lens 14 described above. However, the angles of the facets in the Fresnel lens portion 128 are calculated in the same way as described above, and the Fresnel lens portion 128 has the same basic diverging purpose.

The arrangement of the lower compartment 118 is also similar to that described above. The lower compartment has a pair of aligned semi-circular grooves 130, one on each sidewall 112, 114, that are provided to secure a mounting clip 132 that has complementary rounded ridges 134 to engage the grooves 130. There is one particular difference, though: in the lower compartment, the lowermost portions of the sidewalls 112, 114 have inner sidewalls with an outward cant to them. These outwardly-canted sections 136 make the opening of the lower compartment 118 wider and gradually narrow (i.e., the sidewalls 112, 114 gradually thicken) away from the opening until the grooves 130 are reached. The gradual, sloped profile of the outwardly-canted sections 136 may make it easier to seat mounting clips 132 and other such elements. Among other things, the outwardly-canted sections 136 serve as camming surfaces, gradually pushing the ridges 134 inward as the clip 132 approaches the grooves 130.

In the description above, the concept of the lower compartment 118 as a raceway for wiring was described, as was the concept of bringing a power cable through the cross-member 110, rather than through an endcap 108. The luminaire 100 and its channel 102 provide additional structures and elements to facilitate this.

Figure 9:
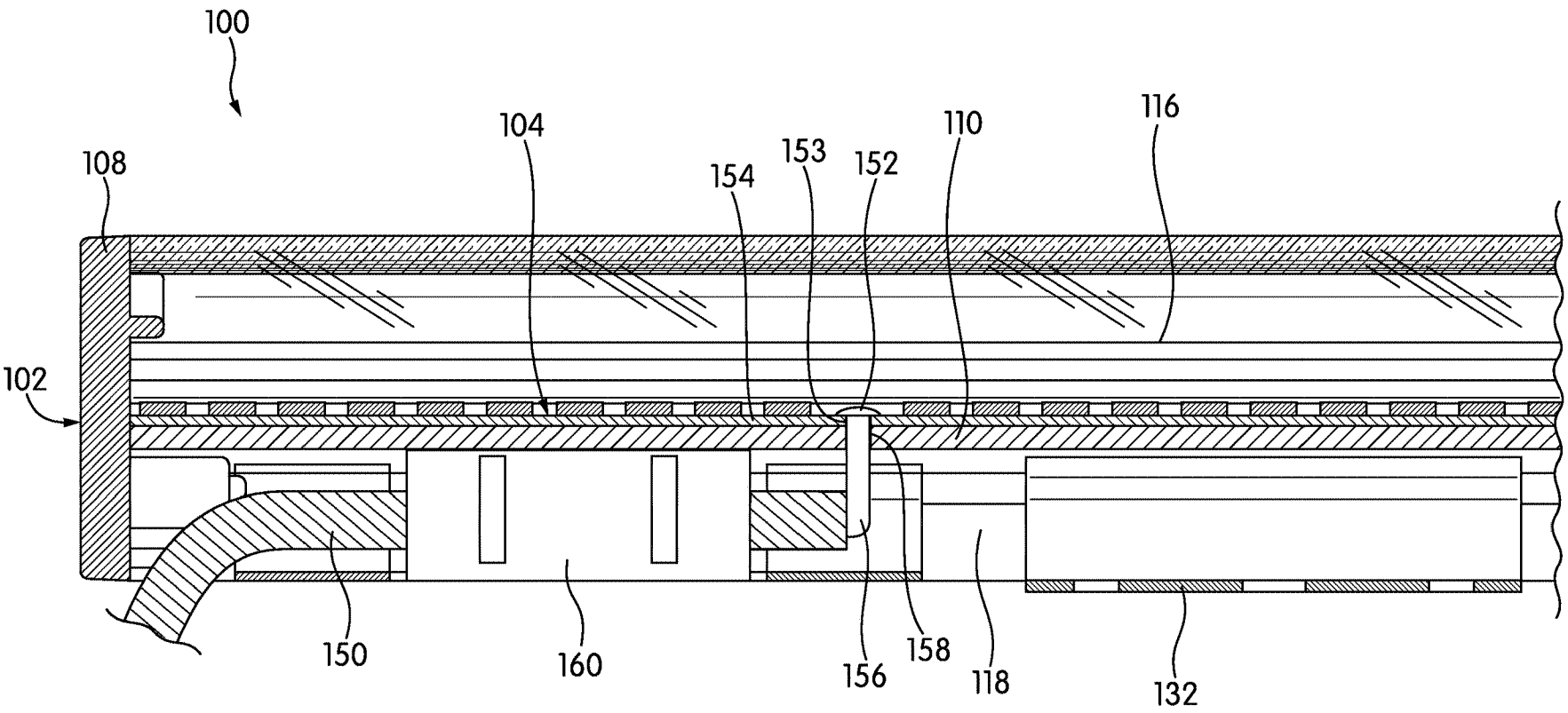
FIG. 9 is a longitudinal cross-sectional view of the linear luminaire of FIG. 7.

FIG. 9 is a longitudinal cross-sectional view of the luminaire 100 and channel 102. In the view of FIG. 9, power is brought to the linear lighting 104 through the lower compartment 118. Specifically, a cable 150 is brought into the lower compartment 118 and uses the lower compartment 118 as a raceway, traversing until it extends just below a set of solder pads 152 on the PCB 154 of the linear lighting 104.

The linear lighting 104 is arranged, as is customary, in repeating blocks. Each repeating block includes a complete lighting circuit that will light if connected to power. All of the repeating blocks are connected electrically in parallel with one another, although they are physically in series along the length of the PCB 154. The set of solder pads 152 typically coincide with the cut points of the PCB 154—i.e., the places where one repeating block may be separated from another. Because there may be any number of repeating blocks along the length of the linear lighting 104, there are typically any number of sets of solder pads 152. In this embodiment, the PCB 154 is assumed to be thin and flexible.

While the term "solder pads" is used for convenience, it should be recognized that the solder pads 152 are electrical connection points that can be connected in any number of ways. In this case, a small hole 153 is punched or drilled in each solder pad 152, and wires 156 from the cable 150 are through-hole mounted in the holes 153 and soldered in place to make physical and electrical contact with the set of solder pads 152. In order to allow the wires 156 to reach the set of solder pads 152, corresponding holes 158 or a slot are punched or drilled in the cross-member 110 that separates the upper compartment 116 from the lower compartment 118. This is done for each wire 156 in the cable 150. Flexible PCB 156 is not typically adapted for through-hole mounting; rather, through-hole mounting is usually used only with rigid PCB. However, because the flexible PCB 156 is secured to and supported by the cross-member 110, through-hole mounting in the holes 153 is possible.

For example, in a practical embodiment, 1 mm holes 153 are punched in each solder pad 152 of a repeating block that is not the first repeating block of the linear lighting 104. Tinned wires 156 are passed through the respective holes 153 and soldered in place. A hole is then drilled or routed in the cross-member 110 under the location of the solder pads 152.

Figure 10:
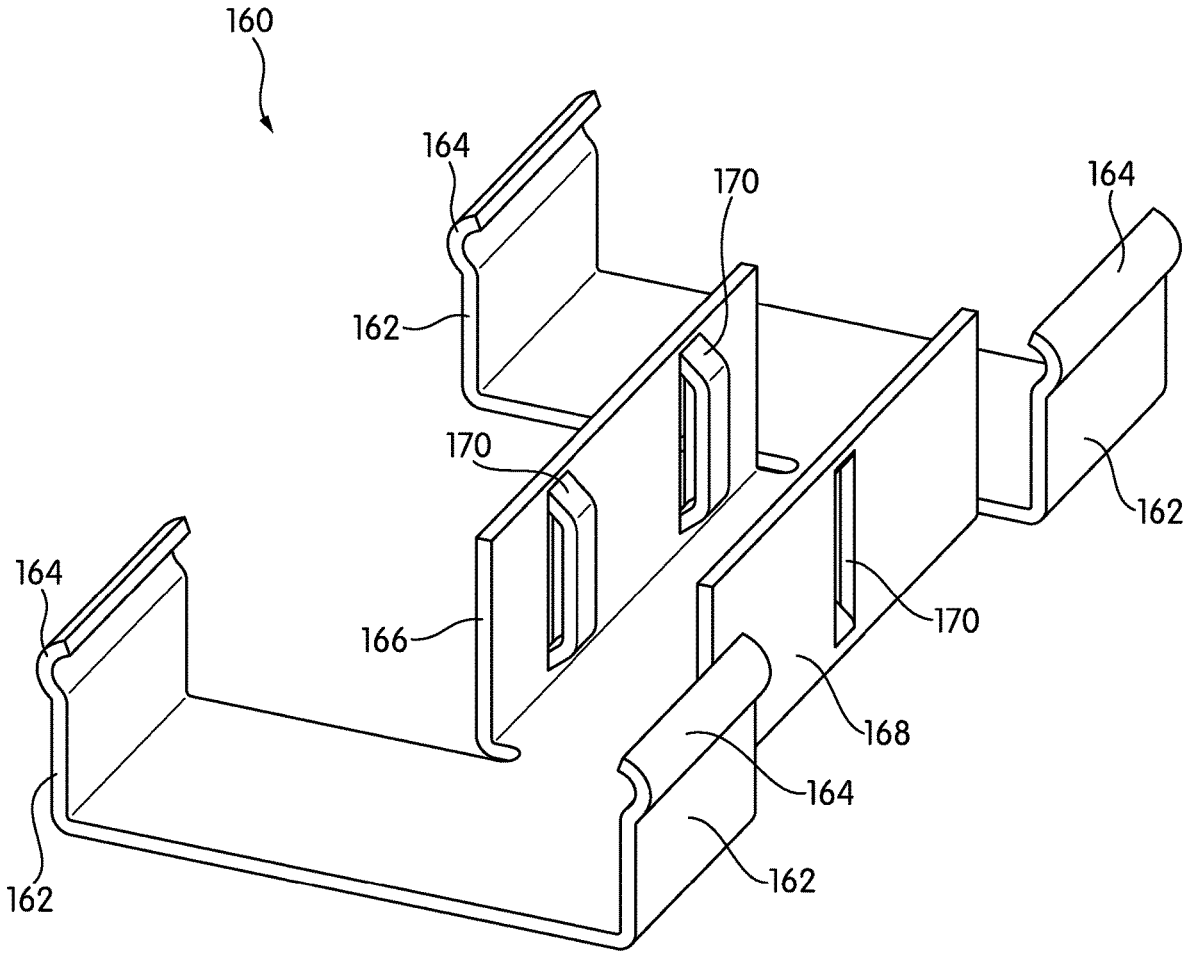
FIG. 10 is a perspective view of a strain relief clip used in the linear luminaire of FIG. 7.

As a last step in the connecting process, the cable 150 itself is clipped into the lower compartment 118 and is supported by a strain relief clip 160 that maintains the position of the cable 150 and provides strain relief. FIG. 10 is a perspective view of the strain relief clip 160 in isolation. The strain relief clip 160 has four upwardly-extending arms 162 that carry rounded ridges 164 to engage the grooves 130 of the lower compartment 118. Arms 162 on opposite sides of the strain relief clip 160 are parallel to one another, and in the illustrated embodiment, each arm 162 lies at a corner of the strain relief clip 160. The number of arms 162 may vary from embodiment to embodiment, and is not critical so long as there is at least one arm 162 on each side of the strain relief clip 160 to secure it.

Between the four arms 162, a set of channel walls 166, 168 arise. The channel walls 166, 168 lie inward from the four arms 162 and are off-center. That is, the center of the channel defined by the channel walls 166, 168 is not aligned with the longitudinal centerline of the strain relief clip 160; rather, it is off to one side. The channel walls 166, 168 are parallel to each other.

As can be appreciated in FIG. 10, the strain relief clip 160 has a rectilinear footprint in plan view. The arms 162 arise along the long sides of the strain relief clip 160. The short sides of the strain relief clip 160 are open to allow the cable 150 to pass.

The channel walls 166, 168 define a relatively narrow channel between them that is sized for the cable 150. In this embodiment, one channel wall 166 has two projections 170, while the other channel wall 168 has a single projection 170 spaced between the two projections 170 of the other channel wall 166. The cable 150 is thus held between the three projections 170. In the illustrated embodiment, the strain relief clip 160 is made of sheet metal that is folded, stamped, and otherwise modified to have the features described. In other embodiments, the strain relief clip 160 could be molded or otherwise manufactured.

Aspects of the invention also relate to methods for installing linear lighting 104 in a channel 102 and connecting the linear lighting 104 to power. As was described briefly above, those methods may involve placing a strip of linear lighting 104 in the channel 102, typically by using pressure-sensitive adhesive on the underside of the linear lighting 104. Alignment features, like the ridges 120 in the channel 102, may be used to align the linear lighting 104 over a distance as it is applied to the channel 102. Once the linear lighting 104 is installed, the location of a set of solder pads 152 is identified, and holes are formed through the cross-member 110 and the PCB 154 at the location of the solder pads 152. The wires 156 from the cable 150 are then routed through the solder pads 152 and through-hole mounting is completed by soldering the wires 156 in place. As a final step, the cable 150 is then secured within the strain relief clip 160.

In some cases, holes may be punched in the solder pads 152 before the linear lighting 104 is laid down in the channel 102. Additionally, holes may be pre-formed or pre-drilled in specific locations in the cross-member 110 along the length of the channel 102. However, it may be easier and more accurate simply to drill holes where needed once the linear lighting 104 is laid.

It should be understood that the methods disclosed here can be used in other types of channels, including U-shaped channels. Additionally, while this description focuses on placing a strip of linear lighting 104 on the bottom surface of a compartment, in other embodiments, the strip of linear lighting 104 may be placed on any surface and the wires 156 routed from any sort of adjacent compartment.

While the invention has been described with respect to certain embodiments, the description is intended to be exemplary, rather than limiting. Modifications and changes may be made within the scope of the invention, which is defined by the appended claims.

What is claimed is:

1. An asymmetrical strain relief clip including:

a base;

at least one pair of upwardly-extending arms arising from opposite sides of the base, upper ends of the at least one pair of upwardly-extending arms carrying engaging structure to engage a compartment of a channel; and a pair of channel walls arising from the base inward of the at least one pair of upwardly-extending arms, each of the pair of channel walls carrying inwardly-extending retaining structure.

2. The asymmetrical strain relief clip of claim 1, wherein the pair of channel walls of the strain relief clip extend parallel to the at least one pair of upwardly-extending arms.

3. The asymmetrical strain relief clip of claim 2, wherein the strain relief clip has a rectilinear shape in plan view and sides perpendicular to the at least one pair of upwardly-extending arms are open.

4. The asymmetrical strain relief clip of claim 1, wherein the engaging structure comprises an outwardly-extending ridge in each upwardly-extending arm of the at least one pair of upwardly-extending arms.

5. The asymmetrical strain relief clip of claim 1, wherein the base includes at least one opening aligned with the pair of channel walls.

6. The asymmetrical strain relief clip of claim 1, wherein the pair of channel walls is positioned off-center in the strain relief clip.

7. A luminaire, comprising:

a channel including first and second sidewalls joined by a cross-member, the cross-member dividing the channel into upper and lower compartments such that the upper compartment is cup-shaped and opens upwardly and the lower compartment is cup-shaped and opens downwardly, the first and second sidewalls having first engaging structure within the upper compartment adapted to engage a cover and second engaging structure within the lower compartment, the channel being elongate with constant cross-section;

a strip of linear lighting installed in the upper compartment of the channel; and a strain relief clip including a base, at least one pair of upwardly-extending arms arising from opposite sides of the base, upper ends of the at least one pair of upwardly-extending arms carrying engaging structure to engage the second engaging structure of the lower compartment, and a pair of channel walls arising from the base inward of the at least one pair of upwardly-extending arms, each of the pair of channel walls carrying inwardly-extending retaining structure.

8. The luminaire of claim 7, further comprising a cable extending from the strip of linear lighting, the cable received in a channel defined by the pair of channel walls of the strain relief clip.

9. The luminaire of claim 8, wherein the cable extends through an opening in the cross-member.

10. A method of assembling a linear luminaire, comprising:

placing a strip of linear lighting on a surface of a channel;

routing wire leads through one or more openings in the surface of the channel, the one or more openings aligned with connection points on the strip of linear lighting; and through-hole mounting the wire leads in the connection points;

wherein the surface of the channel comprises an interior surface of a first channel compartment, the wire leads are routed through an adjacent compartment, and the one or more openings are in a member that divides the first channel compartment from the adjacent compartment.

11. The method of claim 10, wherein the surface of the channel comprises the interior bottom surface of a channel compartment.

12. The method of claim 10, wherein the strip of linear lighting is flexible, and the connection points comprise solder pads.

13. The method of claim 10, further comprising, before said through-hole mounting, punching the through holes at the connection points.

* * * * *